US009925105B1

(12) United States Patent
Hines

(10) Patent No.: US 9,925,105 B1
(45) Date of Patent: Mar. 27, 2018

(54) PATIENT TRANSFER DEVICE

(71) Applicant: UNIQUE Mobility Devices, LLC, Tuscon, AZ (US)

(72) Inventor: Andrew D. Hines, Tuscon, AZ (US)

(73) Assignee: UNIQUIE MOBILITY DEVICES, LLC., Tucson, AZ (US)

( * ) Notice: Subject to any disclaimer, the term of this patent is extended or adjusted under 35 U.S.C. 154(b) by 0 days.

(21) Appl. No.: 15/684,706

(22) Filed: Aug. 23, 2017

(51) Int. Cl.
*A61G 7/10* (2006.01)
*A61G 7/02* (2006.01)

(52) U.S. Cl.
CPC ..... *A61G 7/1015* (2013.01); *A61G 7/02* (2013.01); *A61G 7/10* (2013.01); *A61G 7/1046* (2013.01)

(58) Field of Classification Search
CPC ..... A61G 7/10; A61G 7/1011; A61G 7/1015; A61G 7/1017; A61G 7/1019; A61G 7/1025; A61G 7/1036; A61G 7/1046
See application file for complete search history.

(56) References Cited

U.S. PATENT DOCUMENTS 3,967,328 A * 7/1976 Cox ..... A61G 1/003 5/81.1 C
4,183,109 A 1/1980 Howell ..... A47C 3/32
4,407,543 A 10/1983 Mashuda ..... A61G 5/04
4,427,094 A * 1/1984 Winkelblech ..... B66F 11/04 182/148
4,432,359 A * 2/1984 James ..... A61G 7/1059 297/487
4,752,100 A 6/1988 Lemaire ..... A47C 1/02
4,875,555 A * 10/1989 Johansson ..... A61G 7/1019 187/224
4,941,216 A * 7/1990 Boublil ..... A61G 7/1005 212/253
5,090,072 A * 2/1992 Gray ..... A61G 7/1019 5/86.1
5,095,561 A 3/1992 Green et al. ..... A61G 7/15
5,261,725 A 11/1993 Rudolph ..... B60N 2/22
5,411,044 A * 5/1995 Andolfi ..... A61G 7/1017 135/66
5,456,335 A * 10/1995 Kinsey ..... A61G 7/1011 187/200
5,790,995 A * 8/1998 Caden ..... A61G 7/1005 4/491
5,875,501 A * 3/1999 Jury ..... A61G 7/1011 5/81.1 R
5,916,085 A * 6/1999 Wells ..... A61G 7/053 5/608
6,651,280 B2 * 11/2003 Blevins ..... A61G 7/1011 414/921
7,611,203 B1 * 11/2009 Roberts ..... A61G 7/1011 297/217.7
7,716,759 B2 * 5/2010 Wilder ..... A61G 7/1011 280/47.41
8,777,238 B1 * 7/2014 Blackwood ..... A61G 7/1011 280/47.25
8,783,403 B1 * 7/2014 Robbins ..... A61G 7/1048 180/19.2

(Continued)

*Primary Examiner* — Nicholas F Polito
*Assistant Examiner* — Rahib T Zaman
(74) *Attorney, Agent, or Firm* — Hayes Soloway P.C.

(57) ABSTRACT

A wheeled device for mechanical lifting, and in particular a device, system and method for transferring an object, such as a human patient, from one position and location to another position and/or location.

18 Claims, 6 Drawing Sheets

(56) References Cited

U.S. PATENT DOCUMENTS

| | | | | |
|---|---|---|---|---|
| 8,856,981 | B1 * | 10/2014 | Rayess | A61G 7/1011 5/83.1 |
| 9,039,040 | B2 * | 5/2015 | Zhang | B62B 1/12 280/769 |
| 9,072,643 | B2 | 7/2015 | Hines | A61G 5/14 |
| 2003/0011228 | A1 * | 1/2003 | Komura | A61G 5/14 297/344.12 |
| 2006/0279131 | A1 * | 12/2006 | Kraenzle | B60P 1/30 298/12 |
| 2010/0122406 | A1 * | 5/2010 | Gschwind | A61G 7/1005 4/496 |
| 2011/0016627 | A1 * | 1/2011 | Blevins | A61G 7/1007 5/83.1 |
| 2011/0302712 | A1 * | 12/2011 | Patterson | A61G 7/1019 5/88.1 |
| 2012/0151674 | A1 * | 6/2012 | McKenney | A61G 7/1038 5/86.1 |
| 2013/0269103 | A1 * | 10/2013 | Van Oirschot | A61G 7/1025 5/83.1 |
| 2015/0035333 | A1 * | 2/2015 | Schy | A61G 7/1011 297/331 |
| 2016/0157951 | A1 * | 6/2016 | Schoenig | A61G 7/0503 280/830 |
| 2016/0184158 | A1 * | 6/2016 | Tu | A61G 7/1046 5/87.1 |

* cited by examiner

PATIENT TRANSFER DEVICE

FIELD OF THE INVENTION

The instant invention relates to the field of mechanical lifting devices. The invention has particular utility in connection with a device, system and method for transferring a human or animal patient, from one location to another location, and will be described in connection with such utility, although other utilities are contemplated.

BACKGROUND OF THE INVENTION

Elder care, institutionalized and deinstitutionalized living, and independent living for the disabled and injured are all thriving industries in the United States and across the world. Unfortunately, as humans age or become infirmed mobility and ambulation becomes increasingly difficult, and the ability to take care of oneself often likewise fades. Nevertheless, a great many elderly persons are capable of taking care of themselves, but may on occasion, require assistance. This is similarly true of many disabled or infirm persons, or persons in need of physical therapy, and the like.

Many products have been developed to assist the elderly, disabled, or infirmed (also referred to collectively herein as "elderly") in their own private residences, and their caregivers, or in independent living, assisted care or nursing home environments. As these terms are used herein, a private home or residential environment is defined to include a person's private residence; an independent living environment is defined to include a living environment dedicated to elderly persons capable of living, for the most part, on their own; an assisted living environment is defined to include an environment in which the elderly are capable of living at least partially on their own, but may occasionally, or frequently, require assistance; and a nursing care environment is defined to include an environment in which an elderly person is no longer capable of living on his or her own. Further, an assisted living environment might include an in- or out-patient rehab facility, a hospital, or the like.

Products provided to assist in these types of environments may include, by way of non-limiting example, products that can help an elderly person at least partially support his or her weight, and/or that can assist an elderly person in calling for assistance when needed, such as an emergency bracelet, necklace, or the like capable of dialing 911 on behalf of the elderly person; bathing and/or body cleaning equipment, such as handholds, bath lifts, shower seats, hand-held reaching devices, supports, and foot drying assistance; and assistive measures for use of the toilet, and the like. Assistive products, such as those that assist to transfer or otherwise move elderly persons requiring greater amounts of assistance may include a crane-type lift, such as for patient lifting and water therapy, a bath lift, a toilet assist, a bedside lift, a chair lift, and mobility devices such as scooters, wheelchairs, or the like.

However, none of these products or prior-art embodiments is designed specifically for assisting an elderly person with one of the most frequent occurrences in elder care or self-care namely, assisting an elderly person who has fallen onto the floor, and is unable to lift his or her own weight to get back off the floor. Although very frequently in such situations the elderly person on the floor is uninjured, nevertheless, a call to 911 oftentimes is placed. This may be for example, because the elderly person is unable to reach a chair to support his or her weight in a private residence; work rules prohibit resident personnel or caregivers to assist an elderly person who has fallen due to a potential of risk of injury to resident personnel or to the elderly person. Consequently, an uninjured elderly person on the floor often must wait the arrival of emergency medical personnel, and is subject to embarrassment, or worse yet, time spent alone on the floor due to a lack of desire or ability to call 911, during such occurrences. Needless to say, such solutions, or the lack of solutions, increase not only the expense and time to solve the elderly person's placement on the floor, but additionally unnecessarily increase the stress level of the elderly person. As will be appreciated increased stress, in and of itself, can have an adverse effect on the general health of an elderly person. Also, even well trained care givers and First Responders are prone to injury themselves when assisting a person who has fallen to the floor.

Therefore, the need exists for an improved device that operates at floor level, that is accessible to an elderly person and/or a caregiver, and that is capable of transferring and/or lifting an elderly, disabled or infirm (or injured) person off the floor to at least a seated position or vice versa.

SUMMARY OF THE INVENTION

The present invention provides a device, system and method for assisting an elderly, disabled, or infirm (or injured) person from or near floor level, to at least a sitting position. In particularly preferred embodiments, the device may be, at its lowest or substantially most compressed position, low enough to be accessible to a person lying at or near floor level who may have very limited mobility due to age, a disability, or an infirmity. The device additionally may provide a secondary mode, and/or an optional aspect of the device, for lifting the person, and for moving the person to a seated position and optionally to a standing position.

More particularly, in one aspect of the invention, there is provided a wheeled device comprising: a wheeled base comprising a lower horizontal portion, a mast portion and a lifting support; wherein the mast portion is attached to the wheeled base portion via a base plate, wherein the base plate is pivotally mounted to the wheeled base portion, and aligned to allow the mast to tilt from a substantially upright perpendicular orientation to a forward angled orientation, or to a backward orientation; wherein the lifting support is attached to the mast portion in a manner that allows the lifting support to be raised and lowered on the mast; and wherein a platen is attached to the lifting support such that the platen can be angled relative to the lifting support, wherein the platen protrudes outwardly from the lifting support.

In one aspect of the invention the mast is adapted so that the platen can be lowered to a position that allows a top surface of the platen to be slightly above the floor level.

In another aspect of the invention the wheels are freely rotatable, or are motorized, and optionally further including a drive motor or drive motors for the wheels, and the wheeled base holds or contains a power source such as batteries, a drive motors, and controls. Alternatively or additionally, the device may include ballast to maintain balance and stabilize the device against tipping.

In another aspect of the invention the platen comprises a center section and two outer sections attached to the center section via hinge points that allow the platen outer sections to be moved up or down such that the plate can adjust to a variety of geometric shapes, and wherein the platen and platen outer sections preferably have removable safety guards or rails.

In another aspect of the invention the platen and platen outer section are moveable to form a shape of a chair.

In still another aspect of the invention the device is adapted for remote control via a wireless (Wi-Fi), Bluetooth, radio or other type of communication including a personal area network (PAN), a wireless local area network (WLAN), a mesh network including a ZigBee Communications Protocol, both in a singular or two-way manner, or the device is adapted to operate autonomously via a programmable or AI controller utilizing input and feedback from sensors attached to the device and wherein the sensors comprise optical, proximity, magnetic, machine vision, sound, directional, speed, pressure, thermal, GPS, infrared or combination thereof.

In yet another aspect of the invention the platen is removable.

In still yet another aspect of the invention the device is powered by an electric power source, and the base portion is adapted to hold one or more batteries.

In a further aspect of the invention the platen has a seat portion, a torso support portion and a leg support portion, wherein the platen is configurable to position a patient from a supine position, to an upright sitting position and vice versa.

In a still further aspect of the invention the controls for the control system are located on the device such that the device can be operated by a person on the device.

In yet another aspect of the invention the device includes one or more manual mechanisms, for moving the mast portion, the lifting portion or the platen and any combination thereof.

By way of non-limiting example, the device, system and method for raising a person from a substantially horizontal, substantially floor level position to at least a seated position includes a substantially stable base portion having a profile preferably in the range of less than about 24 inches above floor level and an upper mast portion having at least a portion thereof movably mounted atop said base. The present invention may further include at least one actuator capable of raising, responsive to actuation by said actuator, a lifting portion where the lowermost position and a platen attached to the lifting portion are moved to positions substantially perpendicular to a length of the base. Further, a center section of the platen may include one or more hinged outer sections that when positioned by raising or lowering each section, are capable of accommodating an area of legs of the patient, a seat portion capable of at least partially accommodating a bottom of the patient, and a backrest portion capable of at least partially accommodating a back of the patient. The platen is adapted to move in such a way that a patient lying on the floor can be rolled or slid onto the platen in a horizontal lying position, lifted and moved to a bed while still in the lying position, or the patient can be lifted and moved to a sitting upright position, or an elevated lying position. Thus, the present invention provides a device, system and method that operates from at/or about at floor level, that is accessible to an elderly person with or without the aid of a caregiver, and that is capable of lifting/transferring/repositioning an elderly, disabled (or injured) person off the floor to a lying or seated position. Additionally, the device can be used to autonomously move patients around in a hospital or hospice type setting.

BRIEF DESCRIPTION OF THE FIGURES

Understanding of the present invention will be facilitated by consideration of the following detailed description of the embodiments of the present invention taken in conjunction with the accompanying drawings, in which like numerals refer to like parts and in which.

DETAILED DESCRIPTION

It is to be understood that the figures and descriptions of the present invention have been simplified to illustrate elements that are relevant for a clear understanding of the present invention, while eliminating, for the purpose of clarity, many other elements found in typical mechanical lifting devices, systems and methods. Those of ordinary skill in the art will thus recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art. Furthermore, the embodiments identified and illustrated herein are for exemplary purposes only, and are not meant to be exclusive or limited in their description of the present invention.

The present invention is and includes a device capable of assisting an elderly, disabled, infirm or injured person (hereinafter "elderly person") from a lying or substantially lying position, on or near floor level, i.e. from on the floor to 1 to 3 or so inches above the floor, to at least a sitting position. In a particularly preferred embodiment, the device may be, at its lowest position, low enough to be accessible to a person lying on the floor. The device may be battery powered and/or supplied with sufficient stored hydraulic or spring power to allow the device to locate, tilt, rise or otherwise lower in order to lift a quantity of weight equivalent to a multiple of at least an average adult person. The device preferably is designed to rise to at least the level of a chair, so as to assist a person to at least a sitting position. The device additionally may provide a secondary mode, and/or an optional aspect of the device, for moving/assisting/repositioning/transferring the person once in the seated position to a standing position, or to an elevated lying position.

Figure 1:
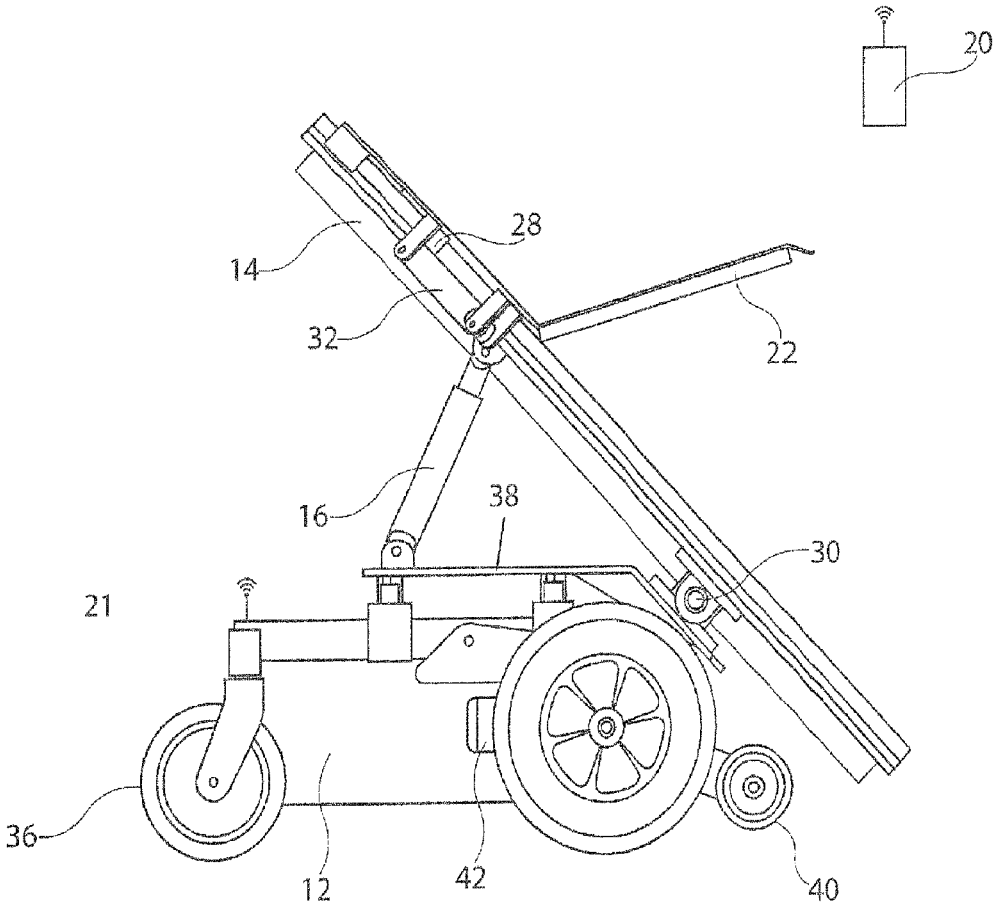
FIG. 1 is an exemplary side view illustration of a mechanically actuatable raising device in accordance with the present invention.
Figure 2:
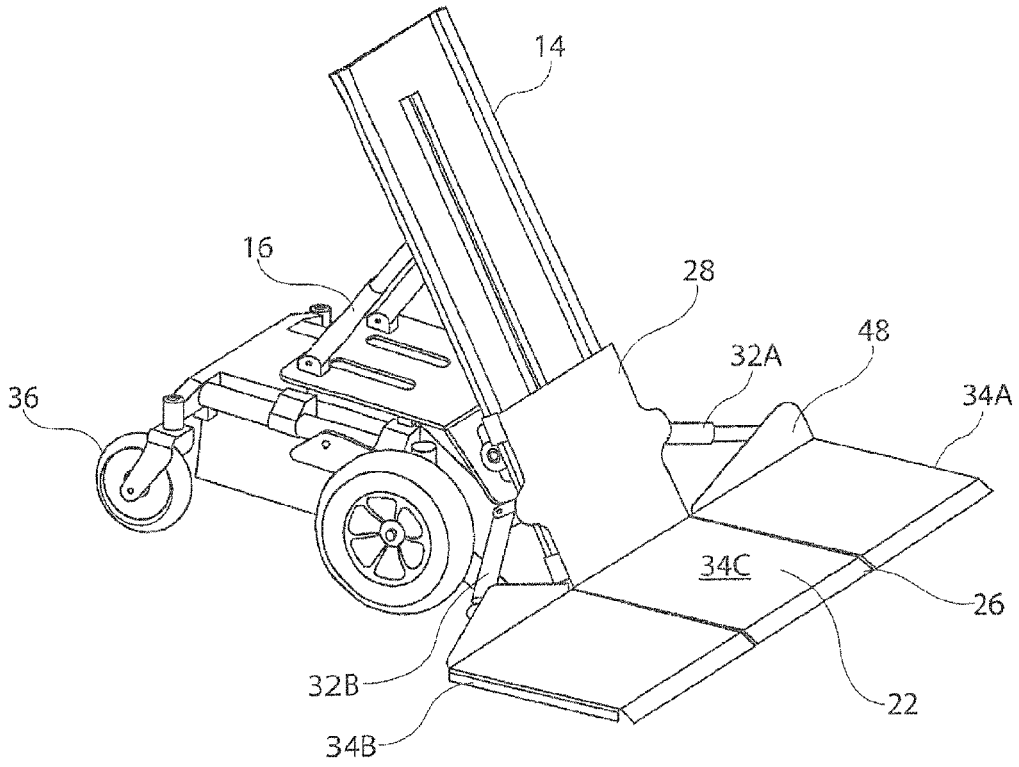
FIG. 2 is an exemplary side view illustration of a mechanically actuatable raising device in accordance with the present invention with the platen at its lowest position

As illustrated in FIGS. 1 and 2, an exemplary embodiment of the device may include a base 12, a moveable mast 14, and at least one lift mechanism/actuator 16 for actuating the mast portion atop the base. FIG. 1 illustrates an early stage with the mast angled backward position, and FIG. 2 illustrates a later stage with the platen in a fully lowered position such that the platen is flat enough and low enough to allow a person lying at the floor level to roll or crawl, or be rolled or slid onto the device, or be scooped up by the device by sliding the platen under the person, and lifting. In a preferred embodiment, the device also may include a remote controller 20 such as a phone and a receiver 21 on the device, such that once the person is positioned on the device and faces upward, the person or a caretaker can actuate controller 20 to cause the actuation of at least a portion of the mast 14 to angle backward over the base 12, whereby the mast and lifting mechanism can be actuated in concert with the platen to raise the platen, and ultimately be converted into at least a chair shape shown in FIGS. 3 and 4 so as to assist the person on the device to a seated position.

Figure 3:
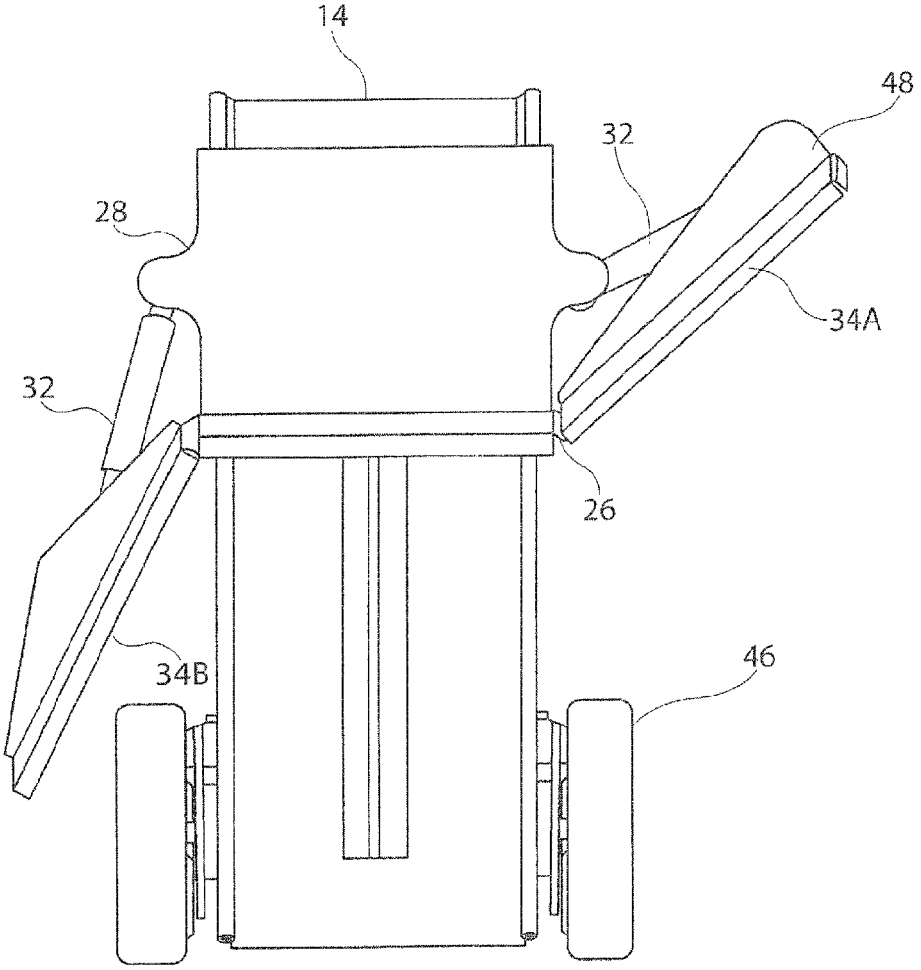
FIG. 3 is a frontal view illustrating an exemplary embodiment of a mechanically actuatable raising device in accordance with the present invention with the platen raised and the platen outer sections configured to form the shape of a chair.
Figure 4:
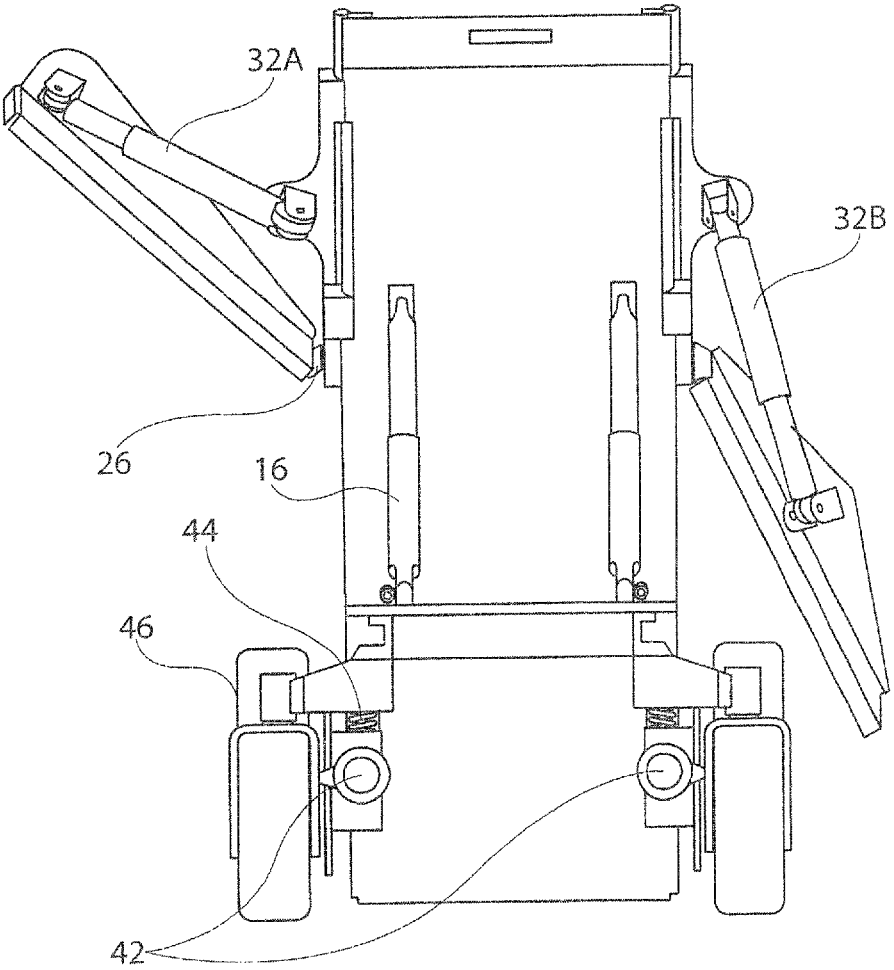
FIG. 4 is a rear view illustrating an exemplary embodiment of a mechanically actuatable raising device in accordance with the present invention with the platen raised and the platen outer sections configured to form the shape of a chair

Referring again to FIGS. 1 and 2, in a preferred embodiment mast 14 supports a platen 22, which in a preferred embodiment has a series of knuckles, slide bolts, hinge bolts, or hinges 26, connecting the platen outer side sections or portions 34A, 34B to the platen center portion 34C, and/or one or more mechanical slides as the lifting portion that attaches the platen to the mast 28. As so constructed, upon actuation of mast 14, one or more of the pivot points 30 mounted to the adjustable base mounting plate 38, allow rotation through a rotational circumferential pursuant to the actuation by actuator 16. And, one or both of the platen sections 34A and 34B correspondingly actuate one or more platen actuators 32A, 32B, while the entire platen and lifting portion 28 moves from a first position to a second position on the mast. Thereby, upon actuation by the actuator 16, the platen actuators 32A, 32B and the lifting mechanism 28 on the mast 14, operate to slowly, safely and substantially linearly bring the platen from a flat or horizontal position (FIGS. 1 and 2) to a seated position as shown in FIGS. 3 and 4.

The one or more actuators 16 and 32A, 32B may be any actuator capable of moving the mast, lifting mechanism and platen in a desired manner so as to support and lift a person from a substantially flat position to a seated position. In an exemplary embodiment, the actuators are comprised of multiple single type linear actuators/motors, although multiple type actuators may be used. For example, the lifting portion attached to the mast may comprise an elongated lead screw type actuating mechanism built into the mast so that as the screw turns via an electric motor the lifting portion and platen attached to the lead screw by a lead screw nut is moved up or down according to the rotation of the motor. In the illustrated embodiment, the actuators can be a variety of types from linear to hydraulic actuators and those skilled in the art are quite familiar with the advantages and disadvantages of each type when applied to device of the present invention.

In the illustrated embodiments of FIGS. 1, 2, 3 and 4, the maximum actuation stroke and power needed are different in the various components. A preferred embodiment preferably may have a combination of hydraulic and electric actuators and the control and operating system for each is different. A hydraulic system provides substantial weight lifting capacity and a slow controllable speed of actuation for lifting the platen 22, while electric actuators may be provided to move the platen hinged outer side portions 34A, 34B up or down by forcing the actuators 16 against the upper mast portion 14, which will cause the platen and lifting portion 28 to begin to rise or lower from the starting position on the base. Upon actuation, the actuators 32A, 32B extend outwardly from the upper lifting portion 28 so that the outer side portions 34A, 34B, reach a position such that they are substantially perpendicular to the base 12 and the floor, while the platen center portion 34C is at least substantially parallel to the base 12 and the floor. The outer side portions 34A, 34B of the platen are lowered and held in position on one side by an actuator 32B and raised and held in position by an actuator 32A on the other side to form a seating position with the mast raised, and held in a position perpendicular to base 12 and the floor. If desired, removable or permanent guards or guard rails 48 may be provided so that the person's extremities are not caught by any of the moving parts.

After being lifted and manipulated to a seated position, a portion of the seat frame may further assist the person from the seated position essentially to a standing position, correspondent by further actuation of the one or more actuators. Such assistance of the person from the seated position to the standing position may occur only upon further actuating of the controller 20 by the person initially laying on the device or the person's caretaker, by way of non-limiting example.

Base 12 may have wheels 36, 46 and/or casters on its underside, so as to allow for the device to be moved. Alternatively, the base 12 may have a track associated with its underside to allow the base to be moved. The track or the wheels preferably include a locking mechanism, and optionally may include extendable leg portions, suction cups, wheels or the like, (hereinafter "stabilizing mechanism" 40), such that the base 12 may be further stabilized immediately upon or soon after activation of the device. Also, if desired, the device may include electric motors 42 to drive wheels 46 which may be axle mounted, to permit the device to pivot or turn by forward rotation of one wheel and backward rotation of the other wheel. The device may also include one or more smaller freely swiveling wheels 36 for stabilizing the device. With the mast at a backward angled position the weight and the center of gravity and balance-point remain substantially located at or about the seat portion over the large wheels 46.

The base may be constructed of a plastic or the like, or a metal, or both, to impart structural integrity and sufficient weight. Also, the base 12 may include a portable power source, e.g., battery storage, for driving motors and control system, or the base may be hard wired for energizing the motors and control system by connection to a wall socket.

Various changes may be made in the above device without departing from the spirit of the invention. For example, the appearance of the device may vary in accordingly with its construction. Also, padding may be provided on the platen, platen seat portion and the platen outer sections.

Additionally, the device, and particularly the control indicated by the aforementioned controller 20, may be configurable, such that when the device is controlled so as to raise only to a seated position, or to a standing position, the rate of rise of the upper frame from the base may be varied. Moreover, configurable nature of the present invention may vary in accordingly with the actuation methodology employed, such as in accordance with the use of linear motion, scissor hinges, a worm screw actuator, or the like.

Various other changes are possible. For example, to minimize the profile and/or floor footprint of the device, the back-rest may be made bendable. Also, the device may be constructed to be waterproof so the patient can be moved into a shower.

Also, if desired torsion bars or suspension springs 44 as shown in FIG. 4 may be provided such that when under power and traveling the suspension helps absorb bumps and sudden changes in the floor height or floor texture to aid in the comfort of the patient being transported.

And, when utilized as a wheelchair the device may then be activated to change position as necessary, such as from sitting to a prone position for the user to dismount onto a bed, for example. Or, upon reaching the proper rotation and position with respect to a target, such as a toilet, the mast may be actuated to move to a forward angular position such as to place a seated person adjacent a toilet bowl. Needless to say, a user of the wheelchair may change the elevation of the platen seat portion and/or the angle of the mast, as is necessary to accommodate the height of a target toilet seat or the like.

Also, a variety of optional components may be provided in conjunction with those discussed above. For example, the one or more actuators may cause, as the seat rises of the upper frame, a "cradle" effect, such that wings on the left and right portions of the seat portion of the platen may be angled or otherwise extended upwardly during actuation such that the bottom of a person resting on the seat is cradled to provide additional stability as the upper frame rises. Further, a seat-belt (not shown) may be provided on the seat portion, to provide further safety measures for the device. Yet further, handles (not shown) may be provided, such as on the front of the seat portion of the platen, in order to further stabilize the person while laying or seated on the platen.

Figure 5:
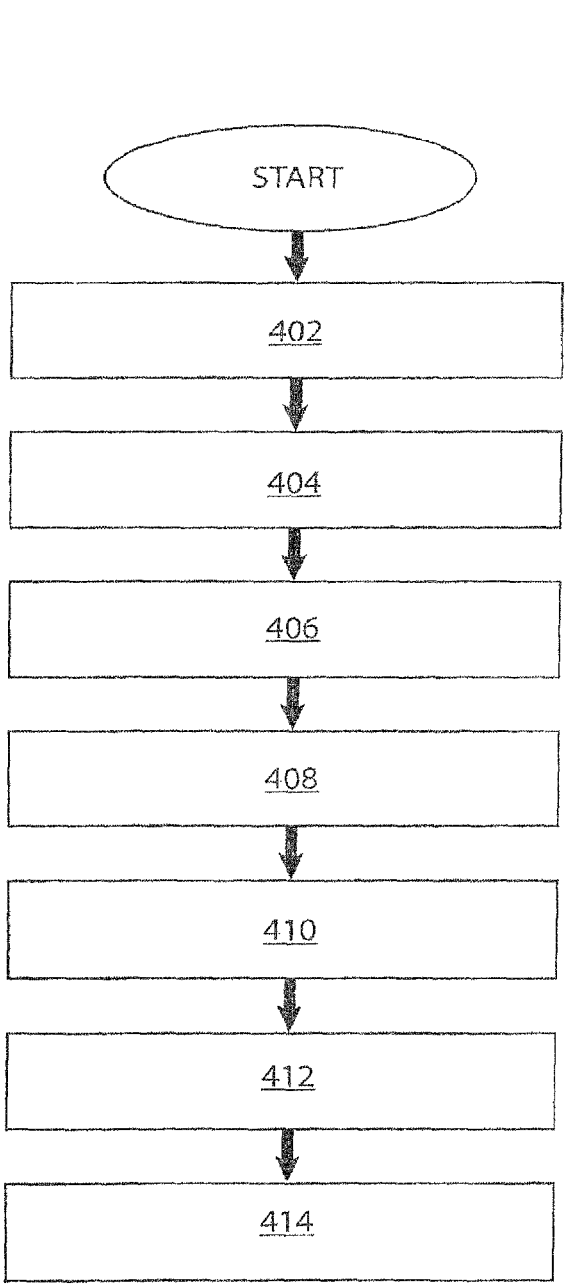
FIG. 5 is a flow diagram illustrating an exemplary method of raising a person from floor

FIG. 5 is a flow diagram illustrative of an exemplary method of using the device in accordance with the present invention. In the illustrated method 400, at step 402 a patient lift device as described above, is provided. At step 404, a user instruction actuates the device and lowers the platen to the floor. A patient is loaded onto the platen, and an actuation instruction is executed at step 406, when it is sensed that the user is properly on the platen.

The platen is then raised at step 408, and the platen manipulated to place the user in a seated position at step 410. Alternatively, and responsive to a secondary user input received at step 412, the device may continue to raise the user from the seated position to an at least substantially standing position. Needless to say, once the person is off the device, the device may be returned, such as by reverse actuation of the actuator, to its original, compressed position at step 414.

Figure 6:
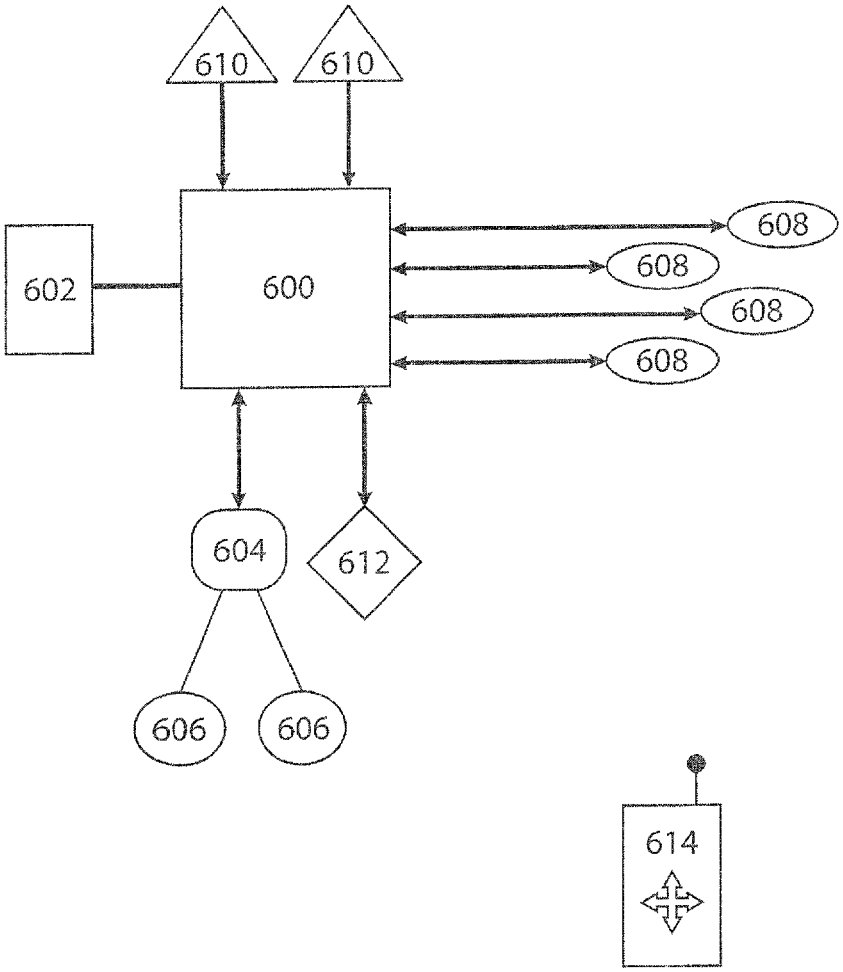
FIG. 6 is a system schematic of a preferred embodiment of the invention.

FIG. 6 is one example of a schematic showing the system components that would be needed in various embodiments. The schematic shows the controller 600 connected to a power source 602 with feedback from sensors 610 and both input and output to the motor controller 604 that drives the motors 606 that drive each of the large wheels 46. To move the mast, lift and platen sections the controller 600 provides output and input to the actuator mechanisms 608 with position feedback from the actuators. In order to operate remotely there is a receiver 612 connected to the controller that provides input and output that is transmitted or received from the remote controller 614.

The device of the present invention has several advantages. It may minimize the risk of injury to professional staff, emergency medical personnel, or a caregiver. Further, the device of the present invention may lower ambulance and other healthcare costs, and may lower aid service costs, response times, independent living or private resident needs, and the like. Furthermore, the device also permits a patient to self-lower to the floor, e.g. to exercise.

Various other modifications and variations of the present invention may be implemented without departing from the spirit or scope of the invention. For example, referring again to FIG. 1, base mounting plate 38 may be rotatably mounted to base 12 so as to permit 90° rotation of the base mounting plate 38 and the mast 14 carried thereon, so as to effectively reduce the width of the device so that the device may be driven through a standard doorway when the patient is in a seated or supine position such that the head to foot axis of the patient is parallel to the principle direction of travel. This permits the patient to face forward when the device is being moved. Also, the present invention has additional utility in other industries, for example the invention can be of particular use in a warehouse to move items such as roll goods in and out of locations as needed and can adapt easily to different shapes of the items it needs to move or reposition. Thus, it is intended that the present invention cover the modification and variations of this invention provided they come within the scope of the appended claims and their equivalents.

The invention claimed is:

1. A wheeled device comprising: a wheeled base having a mounting plate; a mast portion attached to the wheeled base portion via the mounting plate, wherein the mast portion is pivotally mounted to the mounting plate located along a forward portion of the wheeled base wherein the mast portion is tiltable between a forward angled orientation and a backward angled orientation; a lifting support movably attached to the mast portion wherein the lifting support is movable between raised and lowered positions along the mast; and at least three platen sections attached to the lifting support, wherein the at least three platen sections protrudes outwardly from the lifting support, and wherein when the at least three platen sections are positioned substantially at a ground surface, at least two of the at least three platen sections extend laterally sideways from the mast portion to a position beyond opposing terminating side edges of the wheeled base, respectively, and wherein at least one of the three platen sections is connected to the lifting support with at least one platen actuator, wherein the at least one platen actuator is positioned at least partially above a top surface of the at least three platen sections.

2. The device of claim 1 wherein at least one of the at least three platen sections is lowerable to a position that allows the top surface of at least one of the at least three platen sections to be positioned within six inches of a floor level.

3. The device of claim 1, wherein the wheeled base further comprise a plurality of wheels, wherein the plurality of wheels are at least one of: freely rotatable and motorized.

4. The device in claim 1, wherein the wheeled base further includes a power source, drive motors, and controls.

5. The device of claim 1, wherein the at least three platen sections further comprise a center section and two outer sections, wherein the two outer sections are attached to the center section via hinge points that allow the outer sections to be pivoted.

6. The device of claim 5, wherein the center section and the two outer sections have removable safety guards.

7. The device in claim 5, wherein at least one of the two outer sections is moveable relative to the center section to form a shape of a chair.

8. The device of claim 1, further comprising a remote control in communication with the device, wherein the remote control communicates with the device using a wireless signal.

9. The device of claim 1, wherein the device is adapted to operate autonomously via at least one of: a programmable controller and an AI controller utilizing input and feedback from sensors attached to the device, and wherein the sensors comprise at least one of: optical, proximity, magnetic, machine vision, sound, directional, speed, pressure, thermal, GPS, and infrared.

10. The device of claim 1, wherein the at least three platen sections are removable.

11. The device of claim 1, wherein the device is powered by an electric power source, and the wheeled base portion is adapted to hold at least one battery.

12. The device of claim 1, wherein at least one of the three platen sections has a seat portion, a torso support portion, and a leg support portion, wherein the at least three platen sections are configurable to position a patient in at least one of: a supine position and an upright sitting position.

13. The device of claim 1 wherein the device is controllable by a person positioned on at least one of the at least three platen sections of the device.

14. The device of claim 1, further comprising at least one manual mechanism for moving at least one of: the mast portion, the lifting portion, and the at least three platen sections.

15. The device of claim 1, further comprising at least one stabilizing device to prevent the device from tipping.

16. The wheeled device of claim 1, wherein the at least one of the three platen sections connected to the lifting support with at least one platen actuator is connected to the lifting support via a backrest, wherein the backrest is attached to the lifting support.

17. A wheeled device comprising: a wheeled base having a mounting plate; a mast portion attached to the wheeled base portion via the mounting plate, wherein the mast portion is pivotally mounted to an angularly-positioned portion of the mounting plate located along a forward portion of the wheeled base wherein the angularly-positioned portion of the mounting plate has a substantially diagonal orientation relative to a ground surface, wherein the mast portion is tiltable between a forward angled orientation and a backward angled orientation; a lifting support movably attached to the mast portion wherein the lifting support is movable between raised and lowered positions along the mast; and a platen attached to the lifting support, wherein the platen protrudes outwardly from the lifting support.

18. A wheeled device comprising: a wheeled base; a mast portion attached to the wheeled base portion, wherein the mast portion is pivotally mounted to the wheeled base along a forward portion thereof, wherein the mast portion is tiltable between a forward angled orientation and a backward angled orientation; a lifting support movably attached to the mast portion; and at least three platens attached to the lifting support and protruding outwardly therefrom, wherein the lifting support is movable between raised and lowered positions along the mast to raise and lower the at least three platens along the mast, wherein when the at least three platens are positioned substantially at a ground surface, at least two of the at least three platens extends laterally sideways from the mast to a position beyond opposing terminating side edges of the wheeled base, respectively, and wherein at least one of the at least three platens is connected to the lifting support with at least one platen actuator, wherein the at least one platen actuator is positioned at least partially above a top surface of the at least three platen sections.

* * * * *